US006585966B2

(12) United States Patent
Kojima

(10) Patent No.: US 6,585,966 B2
(45) Date of Patent: Jul. 1, 2003

(54) SOLID FOR LUBRICATION AND A PROCESS FOR MANUFACTURING THE SAME

(76) Inventor: Minoru Kojima, 3-11, Azura 1-chome, Ichinomiya-shi, Aichi-ken (JP), 491-0835

( * ) Notice: Subject to any disclaimer, the term of this patent is extended or adjusted under 35 U.S.C. 154(b) by 0 days.

(21) Appl. No.: 09/975,093

(22) Filed: Oct. 12, 2001

(65) Prior Publication Data

US 2002/0068683 A1 Jun. 6, 2002

(30) Foreign Application Priority Data

Oct. 16, 2000 (JP) ..... 2000-315275
Sep. 20, 2001 (JP) ..... 2001-287320

(51) Int. Cl.[7] ..... A61K 31/74; A61K 31/765

(52) U.S. Cl. ..... 424/78.02; 424/78.37; 424/486; 424/487; 424/DIG. 15

(58) Field of Search ..... 508/459, 583; 424/78.02, 78.03, DIG. 15, 78.37, 487, 486

(56) References Cited

U.S. PATENT DOCUMENTS 4,256,591 A * 3/1981 Yamamoto et al. ..... 508/386
4,347,237 A * 8/1982 Evenstad et al. ..... 424/78
5,015,474 A * 5/1991 Parnell ..... 424/64
5,830,576 A * 11/1998 Mehra et al. ..... 424/408
6,036,945 A * 3/2000 Deblasi et al. ..... 424/59
6,194,357 B1 * 2/2001 Murata et al. ..... 508/113
6,197,338 B1 * 3/2001 Nurnberg et al. ..... 424/466
6,274,727 B1 * 8/2001 Maul et al. ..... 536/127

FOREIGN PATENT DOCUMENTS

JP 59-196825 11/1984
JP 63000390 * 1/1988

* cited by examiner

*Primary Examiner*—Jacqueline V. Howard
(74) *Attorney, Agent, or Firm*—Pillsbury Winthrop LLP

(57) ABSTRACT

The present invention relates to a water-soluble solid composition that produces a lubricating liquid when dissolved in water. The composition is preferably prepared by kneading particles of a solid, such as sodium polyacrylate, with water and one or more optional additives to form a mixture. This kneaded mixture is then molded or otherwise formed into a desired shape, preferably one that is easily held such as a lump, sphere, or rod. The shaped composition may also be provided with a partial cover of a water-insoluble material or other modified surface so that it may be held more securely. In use a dry portion of the solid composition can be held in the hand and applied to an area of moistened skin to apply a lubricating liquid without also applying the lubricating liquid to the hand. Similarly, a portion of the solid composition may be moistened and then rubbed on dry skin to apply a lubricating liquid to the skin.

1 Claim, 9 Drawing Sheets

SOLID FOR LUBRICATION AND A PROCESS FOR MANUFACTURING THE SAME

BACKGROUND OF THE INVENTION

1. Field of the Invention

The present invention relates to a solid for lubrication used for supplementing the moisture of skin and making its slide better during massage, sexual intercourse, etc. and also to a process for manufacturing the same.

2. Description of Related Art

When hand is directly touched to the skin (including the mucous membrane) and the force is applied on massaging, there is a possibility that the skin rubbed by the hand is worn out. In addition, during the sexual intercourse, there is a case where the private parts feel pain or their skin is injured. Thus, among ladies after menopause and convalescent or aged people having inconvenience for moving their body, there are many who worry about that. In order to prevent such a trouble, it is preferred that a lubricant liquid is applied to the skin (or to an insert for the skin) to make the slide better followed by doing massage, intercourse, etc. Lubricant liquid for such a use is receiving public attention recently and has been widely sold by, for example, manufacturers of condom. Such a lubricant liquid is sold by placing in a container such as bottle or tube and used by opening the stopper, receiving an appropriate amount on the hand from the opening of the bottle and applying it to the skin.

In the conventional lubricant liquid, however, it is taken by the hand and then applied to the skin or massaged. Therefore, there are problems that the hand becomes unnecessarily sticky, that the hand or the skin becomes dirty depending upon the applied site causing unsanitary conditions and that the using amount is apt to become large whereby clothing and bed sheet are apt to be stained. Further, when hand and fingers are used for massaging a narrow area, there are inconveniences that a pleasant feel is not always achieved and that the parts are scratched by the nail. Furthermore, there are many cases where the lubricant liquid comes out too much depending upon the way of inclining the tube or the way of squeezing the tube and where the lubricant liquid spills too much when the bottle, etc. are fallen down by carelessness whereby the lubricant liquid is wasted.

SUMMARY OF THE INVENTION

Under such circumstances, an object of the present invention is to provide a solid for lubrication which is able to be hygienically used without making the hand unnecessarily sticky and without staining hand, skin, clothing, bed sheet, etc., which is able to be safely massaged with a pleasant touch especially for the parts of narrow area and has no inconvenience of too much coming-out or dropping, and also to provide a process for manufacturing the same.

In order to achieve the above-mentioned object, the following means are adopted.

(1) A solid for lubrication molded into a lump shape where a solid substance for lubrication giving a lubricant liquid upon dissolving in water is used as a main ingredient.

There is no particular limitation for the solid substance for lubrication and its examples are that mainly comprising polyacrylic acid and propylene glycol and that mainly comprising carboxyvinyl, polyacrylic acid and sodium hydroxide. More specific examples are sodium polyacrylate, etc. The same ones may be used in other embodiments as well.

There is no particular limitation for the lump shape and its examples are rod, sphere, disk, a shape of solid soap, rectangular solid and plate.

When the whole solid for lubrication is wetted by water, it is apt to slip when held by hand and is hard to use. Therefore, it is preferred that catching projections for prevention of sliding or uneven shape are/is formed on the surface of the solid for lubrication at least at the site to be held by hand. The similar slide-proof effect is achieved by making into such a constitution that the surface of the solid for lubrication at least at the site to be held by hand is covered by a water-insoluble cover and the said solid is held by hand over the said cover. That is the same in other means as well.

(2) A process for the manufacture of a solid for lubrication where water is added to particles of a solid substance for lubrication giving a lubricant liquid upon dissolving in water and kneaded and the kneaded substance is molded into a lump shape.

Although there is no particular limitation for the amount of water added, the ratio of 1–3 part(s) to 1 part of the particles of the solid substance for lubrication is preferred. This is because, when the amount of water is too small, the solid for lubrication becomes too hard, while, when it is too much, the said solid becomes too soft. Although there is no particular limitation for water, hardening rarely takes place in the case of pure water and, therefore, it is preferred to contain a very small amount of divalent or higher metal salt (common tap water satisfies such a condition). Examples of the metal salt are sodium salt, magnesium salt and potassium salt.

Kneading is not limited to a particular method and, although a rotary motion using a rotary mixer may be adopted, it is preferred in view of little frictional heat to carry out in a manner of, such as, mochitsuki (pounding of steamed rice using mortar and pestle) using a stamping mixer. There is no particular limitation for the method of making into a lump shape and its examples are extrusion molding (followed by cutting or slicing into a predetermined size), injection molding and press molding.

(3) A process for the manufacture of a solid for lubrication where a binder is added to particles of solid substance for lubrication giving a lubricant liquid upon dissolving in water and mixed and the mixed substance is subjected to a compression molding to give a lump shape.

Examples of the binder are paste, sodium carbonate and sodium sulfate. There is no particular limitation for a compression molding and, for example, that may be carried out by means of tabletting.

(4) A process for the manufacture of a solid for lubrication where a solidifying agent is added to a lubricant liquid to solidify and also to molding into a lump shape.

Examples of the solidifying agent are agar, gellan gum (natural polysaccharides), hydrophilic or hydrophobic polyisocyanate compound, carrageenan, pectin, gelatin, starch and sodium alginate. Here, the term solidifying includes gelling. There is no particular limitation for a method of molding into a lump shape and its examples are extrusion molding (followed by cutting or slicing into a predetermined size), injection molding and press molding.

When a solidifying agent has a property that it solidifies when dissolved in water, heated and the cooled such as agar, gellan gum, carrageenan and xanthan gum, heating may be carried out after adding a solidifying agent to a lubricant liquid although it is preferred to add a solidifying agent after heating a lubricant liquid.

Although there is no particular limitation for a lubricant liquid, that which is prepared by dissolving the above-mentioned solid substance for lubricant liquid in water is appropriate.

(5) A process for the manufacture of a solid for lubrication where a solid substance for lubrication giving a lubricant liquid upon dissolving in water is dissolved in water and the resulting dissolved matter in a gel form is molded into a lump shape.

Advantages of the process is that granular lumps are hardly formed and a uniform solid substance for lubrication without non-homogeneity can be manufactured. There is no particular limitation for a method for the dissolving and an example is a method where a solid substance for lubrication is dissolved by a gradual addition to water using a rotary mixer equipped with a stirrer.

(6) A solid for lubrication which is molded in a lump shape and gives a lubricant liquid when dissolved in water.

With regard to the main ingredient of the solid for lubrication, the solid substances for lubrication mentioned in the above-mentioned means (1) may be exemplified. In addition, as will be exemplified in the Examples given later, various kinds of additives and antiseptics may be added. With regard to the addition as such, that is same in the solid for lubrication in the above-mentioned means (1) as well.

Although there is no particular limitation for the hardness of the molded solid for lubrication, it is preferred that the hardness at ambient temperature as measured by a rheometer method is within a range of from $1\times10^4$ to $2\times10^5$ N/m$^2$ and, more preferably, within a range of from $2\times10^4$ to $1\times10^5$ N/m$^2$.

Other objects of the present invention will be apparent when the embodiments given later are understood and will be clearly mentioned in the attached claims. When persons skilled in the art carry out the present invention, they will find many advantages which are not mentioned in the present specification.

DETAILED DESCRIPTION OF THE PREFERRED EMBODIMENTS

The solid for lubrication 1 of the present invention as shown in FIG. 1 is a solid for lubrication which is molded in a lump shape and gives a lubricant liquid when dissolved in water. It is molded into a rod-like shape, according to a process as shown below, comprising sodium polyacrylate as a main ingredient giving a lubricant liquid when dissolved in water.

EXAMPLE 1

Figure 2:
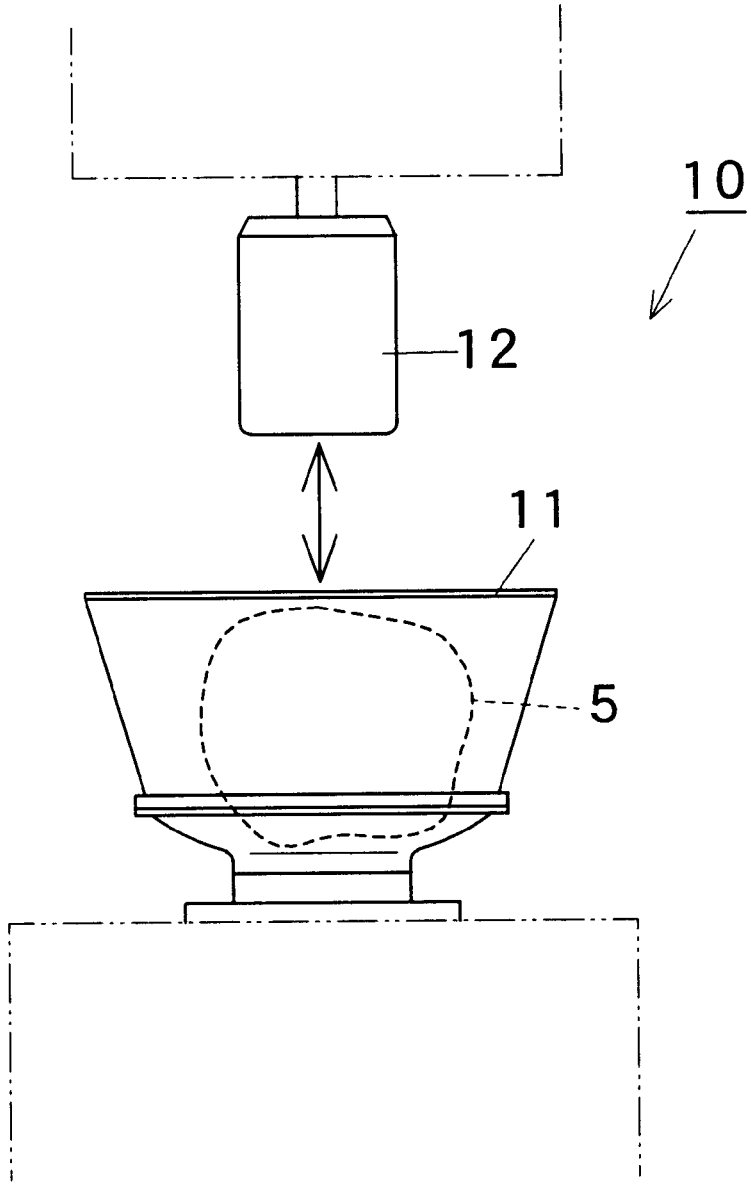
FIG. 2 is a brief drawing of a stamping mixer used for the manufacture of the solid for lubrication.

In Example 1, at first, water was added to particles of sodium polyacrylate using a stamping mixer 10 (only necessary parts are shown) to knead as shown in FIG. 2. As to the particles of sodium polyacrylate, fine particles of "Aronbis" which is a product of Nippon Junyaku were used and, as to water, tap water containing divalent or higher metal salt was used. Incidentally, the ratio of the sodium polyacrylate particles to water to be kneaded was made 1:2.

Specific kneading method is as follows. Firstly, particles of sodium polyacrylate was placed in a mortar 11 of a stamping mixer 10. Then water is added to the particles together with rotation of the mortar and the pestle 12 is moved up and down whereby the particles and water in the mortar 11 are kneaded as if pounding of steamed rice in a mortar with a pestle. When the stamping mixer 10 is used, a kneaded product 5 can be prepared suppressing the generation of frictional heat.

The kneaded product 5 may be compounded with an additive such as carboxyvinyl polymer, concentrated glycerol, propylene glycol and hyaluronic acid or an extract such as placenta extract, caropeptide, squalane, collagen, jojoba oil, extract of seed of *Coix ma-yuen,* melissa extract, chamomile extract and dipotassium glycylrrhizinate or an antiseptic agent such as methylparaben and sodium benzoate may be added thereto. It is also possible to add an additive such as sodium bicarbonate, urea and dextrin and, in that case, the ratio of sodium polyacrylate particles, additive and water is, for example, 1:[1~2]:[2~2.5].

Figure 1A:
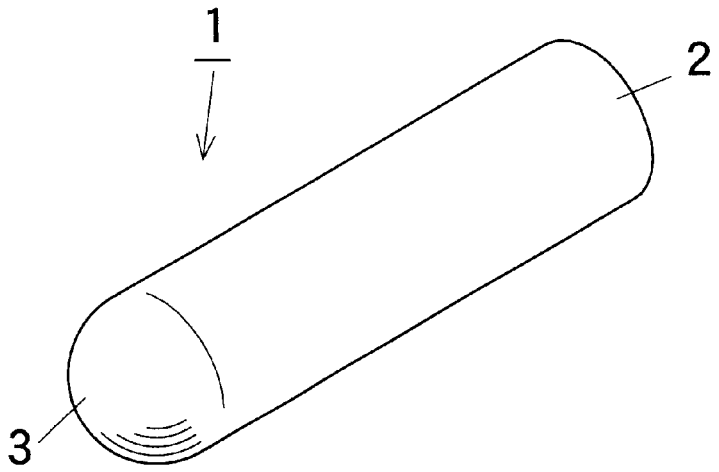
FIG. 1A is a brief oblique view of a solid for lubrication where the present invention is embodied and FIG. 1B is a brief drawing which shows the state of use of the solid for lubrication.
Figure 3:
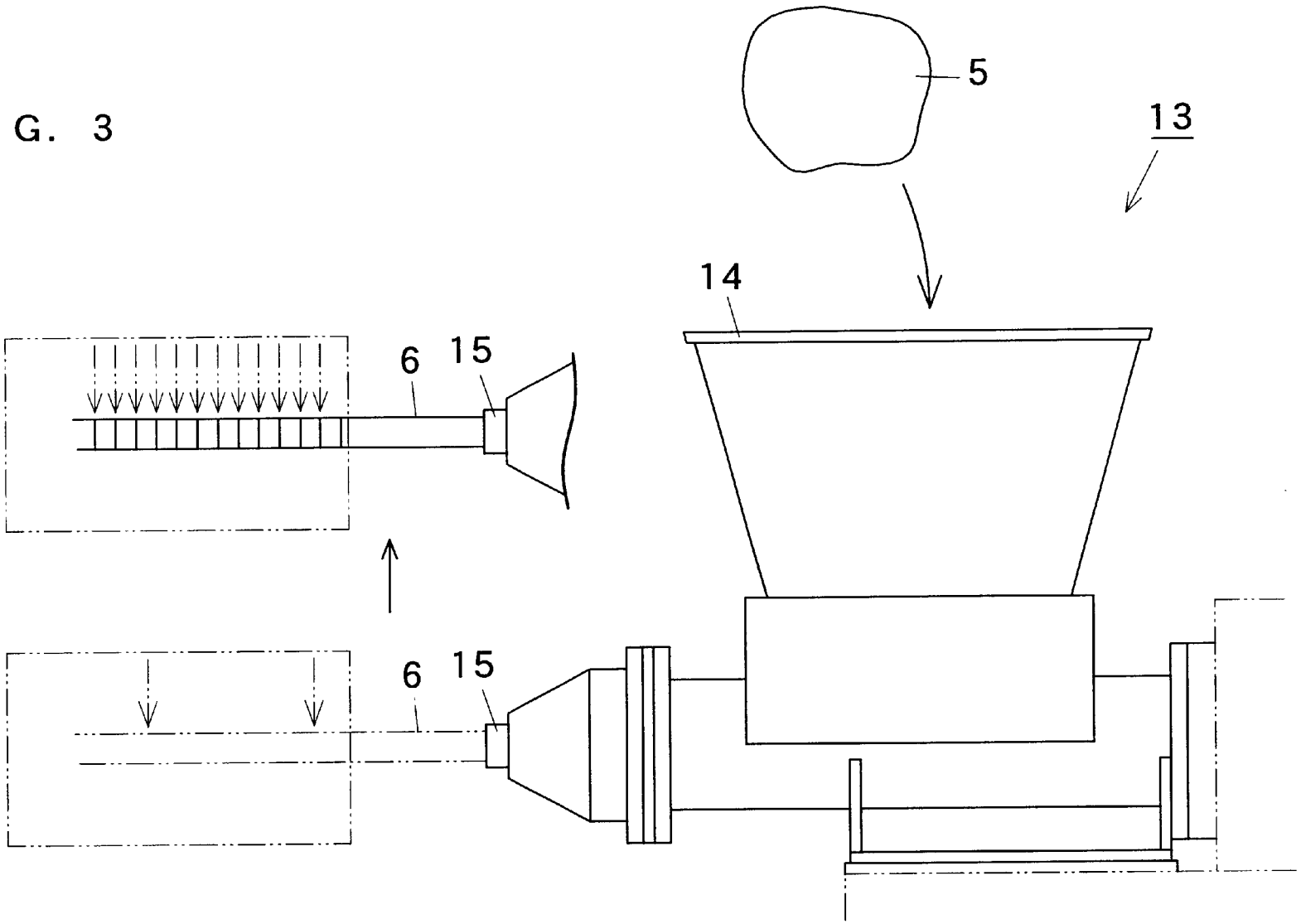
FIG. 3 is brief drawings of an extruder used for the manufacture of the solid for lubrication.
Figure 6A:
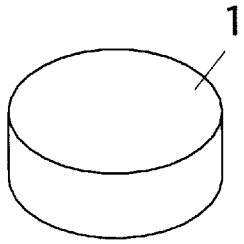
FIG. 6A–6F is brief oblique views showing another example of the solid for lubrication.
Figure 6B:
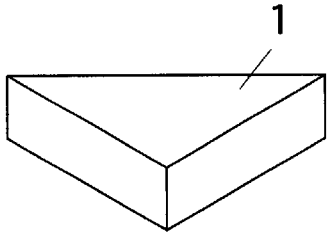
Figure 6C:
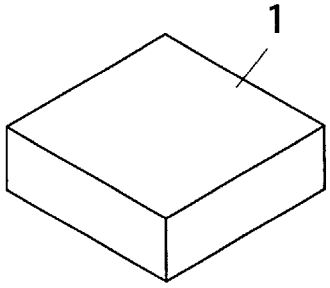
Figure 6D:
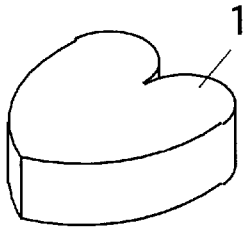
Figure 6E:
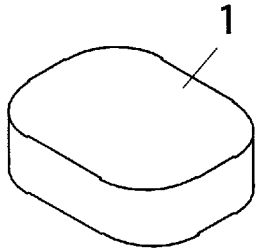

After that, the resulting kneaded substance 5 was subjected to an extrusion molding into a rod shape using an extruder 13 (only necessary parts are shown) as shown in FIG. 3. A specific molding method is that, firstly, a kneaded substance 5 is placed in a hopper 14 of an extruder 13, the extruder 13 is driven and a molded product 6 is extruded in a rod shape from an extrusion dice 15 having a round cross section. Then the molded product 6 is cut with a relatively long span as shown by arrows with two-dashed chain lines in FIG. 3 to give a solid for lubrication 1 in a round rod shape as shown in FIG. 1*a*. Although there is no particular limitation for a cutting method for the molded product 6, it is preferred to continuously carry out that using a slicer 16 (only a contour thereof is shown by a two-dashed chain line). The cutting span of the slicer 16 can be freely changed and, in the case of a long span as in the present Example, a rod-shaped solid for lubrication 1 is obtained while, in the case of a short span as shown in the upper part of FIG. 3, a disk-shaped solid for lubrication 1 as shown in FIG. 6A is obtained.

Incidentally, besides the above-mentioned extrusion molding, it is also possible that, for example, adding amount of water is made more to knead giving a little soft kneaded product 5 and this kneaded product 5 is injected into a mold (not shown) to give a solid for lubrication (injection molding).

Figure 1B:
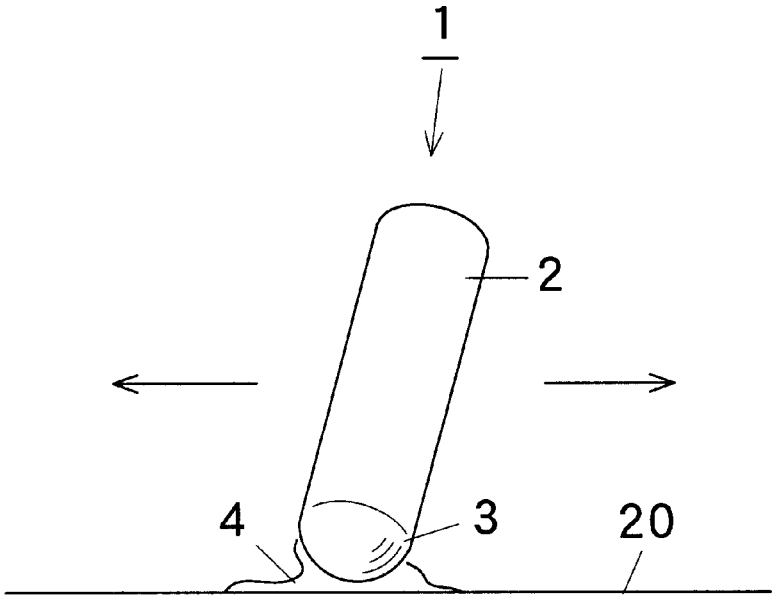

Now, when the solid for lubrication 1 having the above-mentioned constitution is used, the rear end of the solid for lubrication 1, for example, is held by hand while the front end 3 is dipped in water whereupon sodium polyacrylate on the surface of the solid for lubrication 1 is dissolved in water to give an appropriate amount of lubricant liquid 4. Then, as shown in FIG. 1*b,* the rear end 2 of the solid for lubrication 1 is held by hand, the front end 3 is attached to the skin 20 and the skin 20 is massaged by moving the solid for lubrication 1 together with supplementing the moisture of the skin 20 with the lubricant liquid 4.

As such, in accordance with the solid for lubrication 1, it is possible that a part is held by hand while another part can be used for applying the lubricant liquid 4 to the skin or for massaging the skin 20 whereby a hygienic use is achieved without unnecessarily making the hand sticky or without staining the hand or the skin 20. In addition, when the skin 20 is massaged by a softened site connecting to the site which becomes a lubricant liquid 4 in the front end 3 of the solid for lubrication 1, the parts having a narrow area can be safely massaged with a pleasant touch and, further, without scratching by nail.

Further, in the solid for lubrication 1, sodium polyacrylate on the surface gradually dissolves in water to give an appropriate amount of a lubricant liquid 4 and does not dissolve excessively. Therefore, unlike the conventional cases using liquid, the lubricant liquid 4 is neither released too much nor dropped and, in addition, it is rare that the liquid drops therearound to stain the clothing and the bed sheet. The solid for lubrication 1 is economical too since it can be used repeatedly by dissolving little by little. Further, the solid is convenient to carry since it is a solid.

Figure 4A:
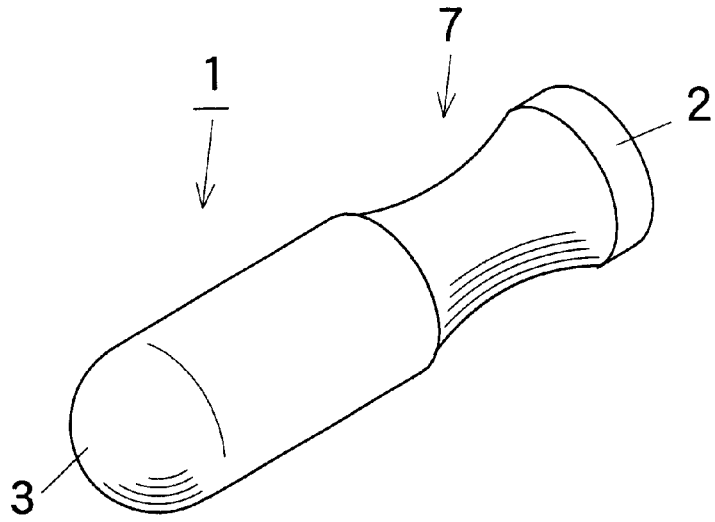
FIG. 4A–4B is brief oblique views showing another example of the solid for lubrication.

FIG. 4 shows a modified examples of the solid for lubrication 1 and, in the solid for lubrication 1 in FIG. 4A, a concave 7 is formed on the surface of the rear end 2 whereby an uneven shape is produced. According to such a shape, the uneven shape functions as a slide preventer even when not only the front end 3 but also the rare end 2 are wetted by water and, therefore, the solid hardly slides and is easy to use when the concave 7 is held by hand.

Figure 4B:
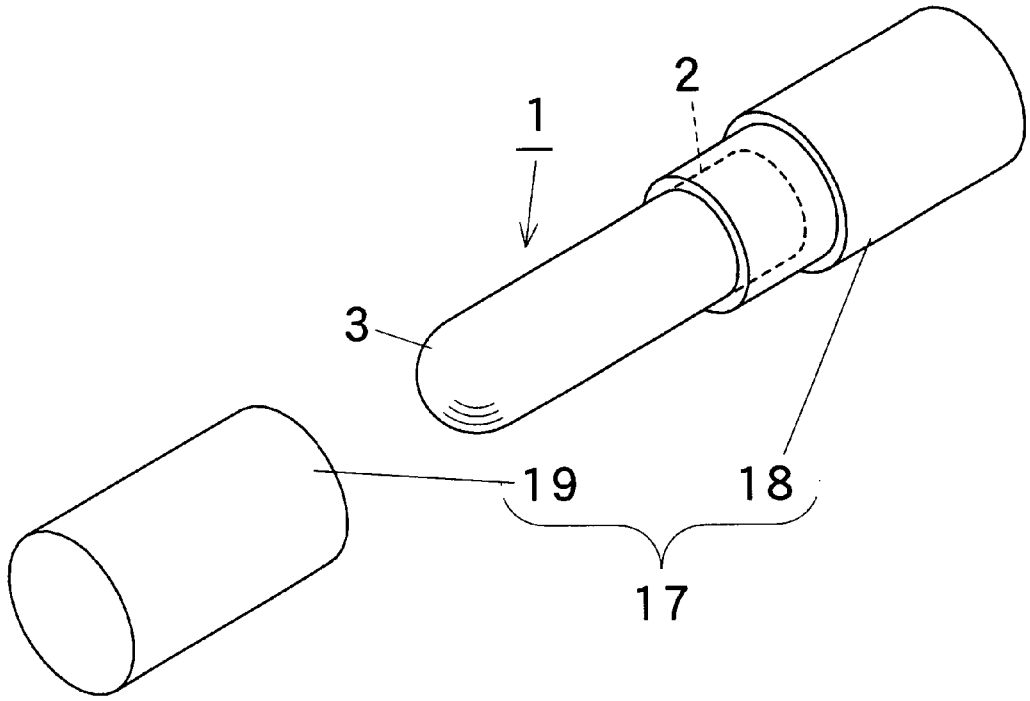

Now, a solid for lubrication 1 of FIG. 4B is received in a tubular container 17 made of metal or resin such as a lipstick case. The tubular container 17 is equipped with a grip 18 which is inserted in an undetachable manner at the rear end 2 of the solid for lubrication 1 and a cover 19 which is mounted in a detachable manner at the front end 3. Although the grip 18 may be a simple cover which just covers the rear end, that which is equipped with a drawing-out function such as in a lipstick case is preferred. The solid for lubrication 1 in such a constitution hardly slides in use and can be used easily since it is used by holding the grip 18 which is not dissolved in water by hand.

Figure 5A:
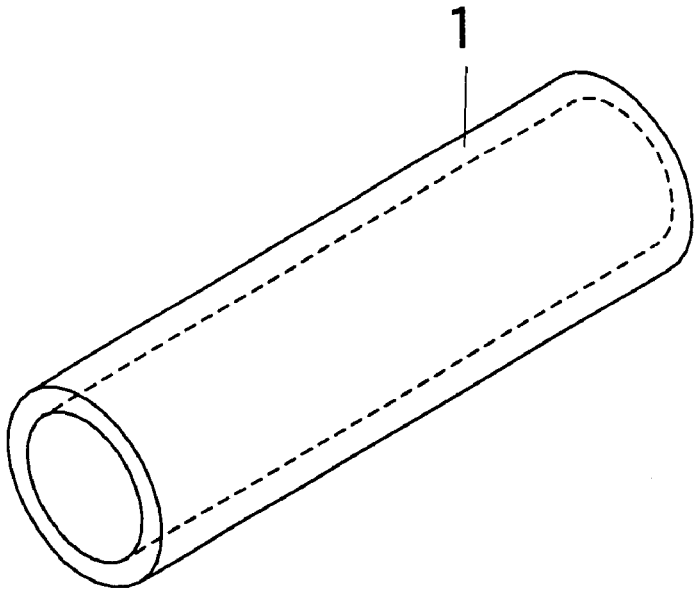
FIG. 5A–5B is brief oblique views showing another example of the solid for lubrication.
Figure 5B:
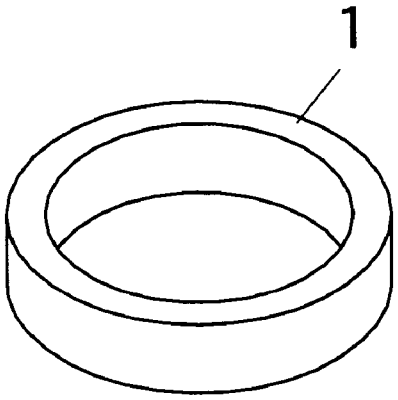

The solid for lubrication 1 may be molded in a lump form which is other than a rod shape. Solids for lubrication 1 in various shapes can be prepared when size and shape of the extruding dice 15 of the extruder 13 are changed and the cutting position for the molded product 6 is changed. For example, FIG. 5A shows a solid for lubrication 1 in a tubular rod shape prepared by cutting a molded product 6 extruded from an extruding dice 15 having a ring-shaped cross section with a slicer 16 having a relatively long span. FIG. 5B shows a solid for lubrication 1 in a ring shape prepared by cutting the same molded product 6 with a short span. Such hollow solids for lubrication 1 are suitable for use by applying outside of the insert for the skin 20. FIG. 6A to 6E show solids for lubrication 1 in a form of disk, triangular platelet, square platelet, heart-shaped platelet and solid soap shape prepared by cutting a molded product 6 extruded from an extruding dice 15 having cross sections of circle, triangle, square, heart shape and long circle, respectively using a slicer with a short span.

Figure 6F:
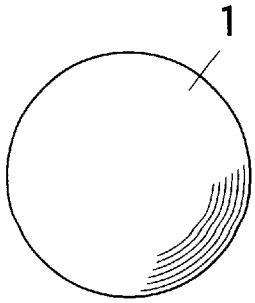

Incidentally, the solid for lubrication 1 may be molded into a specific shape without the use of an extruder but the kneaded substance 5 is molded by handwork. FIG. 6F shows a sold for lubrication 1 in a spherical shape which is molded by handwork. In the meanwhile, even when an extruder 13 is used, small pieces in a shape of hailstone are produced when the molded product 6 is cut. When such small pieces are not discarded but are collected and placed in a net bag by handwork, they can be utilized as a solid for lubrication.

EXAMPLE 2

In Example 2, a binder was added to particles of sodium polyacrylate followed by mixing and the resulting mixture was subjected to a compression molding into rods. As to the particles of sodium polyacrylate, 15% of fine particles of Aronbis which was same as that in Example 1 were used while, as to the binder, 10% of paste (the first binder) were compounded with sodium bicarbonate and sodium sulfate (second binder) and used. The mixture of fine particles of sodium polyacrylate with the binder was compounded with lactose granules or sodium chloride followed by adding an antiseptic agent such as methylparaben and sodium benzoate thereto. The mixture prepared as such was tabletted to give a solid for lubrication 1 in a round rod shape as shown in FIG. 1A.

The solid for lubrication 1 of Example 2 can be used by the same method as in Example 1 whereby the same effect as in Example 1 is achieved. However, it is necessary to add a binder in addition to the particles of sodium polyacrylate and, since a binder in general is hardly soluble in water, there are some problems that, when once used and then dried, the binder remains on the surface of the solid for lubrication 1 and the touch is rough. There are additional problems that, since swelling is apt to take place, strength lowers when repeatedly used and, upon storage for a long period, its strength lowers. Therefore, it is preferred to take a method for use wherein such problems do not occur.

EXAMPLE 3

In Example 3, a solidifying agent was added to a lubricant liquid and molded into a lump form. Depending upon the type of the solidifying agent added, explanation will be made by classifying into from 3-1 to 3-5.

EXAMPLE 3-1

Agar ("Inagel N-65, UP-37", trade name, manufactured by Ina Shokuhin Kogyo; dissolving limit at 100° C.: 15%) was used as a solidifying agent. To be more specific, 2.0–3.0% of agar, 0.05–0.1% of antiseptic agent such as methylparaben and sodium benzoate were added to the lubricant liquid and the mixture was dissolved by heating and solidified by cooling to give a rod-shaped solid for lubrication.

The resulting solid for lubrication can be used by the same method as in Example 1 whereby the same effect as in Example 1 is achieved. However, although the product is solidified, there are some problems that it is fragile and is apt to release water therefrom, reduces its volume and finally becomes about 1/20 of the initial stage (about 5% of sodium polyacrylate and agar in the lubricant liquid). Therefore, it is preferred to take a method for use causing no such a problem.

EXAMPLE 3-2

As a solidifying agent, gellan gum (natural polysaccharide; "Kelcogel", trade name, manufactured by Dainippon Pharmaceutical) was used. To be specific, water was added to 50 g of lubricant liquid to make 100 g and heated up to 80° C. and 1 g of gellan gum was added thereto (range of addition was around 0.1% to 2%). After that, 0.25 ml of a 10% aqueous solution of calcium chloride was added and then 0.025 g of methylparaben was added. The resulting mixture was heated to dissolve at 90° C. for 5 minutes and then solidified by cooling to give a rod-shaped solid for lubrication.

The resulting solid for lubrication can be used by the same method as in Example 1 whereby the same effect as in Example 1 is achieved. Although the product is excellent in terms of elasticity and strength and shows an improved time for water release as compared with Example 3-1, there are some problems that it is insufficient for putting into the market.

EXAMPLE 3-3

A hydrophilic-hydrophobic polyisocyanate compound ("Polygrout", trade name, manufactured by Daiichi Kogyo Seiyaku) was used as a solidifying agent. To be specific, 10–30% of a polyisocyanate compound and an antiseptic agent such as methylparaben and sodium benzoate were added to 90–70% of a lubricant for lubrication followed by well stirring for 2–3 minutes. As a result, a tough rubber-like elastic gel was formed and a rod-shaped solid for lubrication was obtained.

The resulting solid for lubrication can be used by the same method as in Example 1 whereby the same effect as in Example 1 is achieved. In addition, a lubricant liquid can be solidified within short time. However, the solid for lubrication in this Example is not a uniform and smooth solid and, therefore, its appearance is poor. There is another problem that release of water therefrom also takes place and the size becomes one-half or smaller after several days from molding. Therefore, it is preferred to adopt a design and a method for use whereby such a problem does not occur.

As a gelling-solidifying agent other than a polyisocyanate compound, it is possible to use carrageenan, pectin, gelatin, starch and sodium alginate.

EXAMPLE 3-4

As a solidifying agent, glycerol fatty acid ester ("Poly-Em M-300", trade name, manufactured by Riken Vitamin) was used. To be specific, 70–25% of the lubricant liquid were mixed with 30–75% of glycerol fatty acid ester and antiseptic agent such as methylparaben and sodium benzoate and the mixture was dissolved by heating followed by solidifying upon cooling to give a solid for lubrication.

The resulting solid for lubrication can be used by the same method as in Example 1 whereby the same effect as in Example 1 is achieved. However, there are some problems that the solidifying agent and lubricant liquid are not sufficiently compatible and mixing of liquids is difficult. Therefore, it is preferred to add an affinity agent causing no such problems.

EXAMPLE 3-5

As to a solidifying agent, carrageenan ("Soagina", trade name, manufactured by MRC Polysaccharide) or xanthan gum ("Soaxan", trade name, manufactured by MRC Polysaccharide) was used. To be specific, to a lubricant liquid where 15% of sodium polyacrylate, 15% rice powder and 5% of sea algae were added extract, antiseptic agent, etc. if necessary, the mixture was heated up to 80° C., 5% of carrageenan or xanthan were added thereto and dissolved therein and solidified by cooling to give a rod-shaped solid for lubrication. The above compounding ratio is % by weight.

The resulting solid for lubrication can be used by the same method as in Example 1 whereby the same effect as in Example 1 is achieved.

In the above-mentioned Example 3, extrusion molding, injection molding and press molding may be exemplified as a molding method making into a lump shape as mentioned above and injection molding is preferred because molding into any shape is possible by that. In the case of an injection molding, a lubricant liquid after the above heating/dissolving is injected into a mold and is solidified by cooling in the mold.

EXAMPLE 4

In Example 4, particles of sodium polyacrylate were dissolved in water using a rotary mixer equipped with a stirrer 23 (only necessary parts are shown) and the resulting gel-like solution was molded into a lump shape. As to the particles of sodium polyacrylate, fine particles of "Aronbis" as same as in Example 1 were used while, as to water, tap water containing divalent or higher metal salt was used. Compounding amounts were 6 kg of water, 1 kg of sodium polyacrylate and 1.5 kg of rice powder as an additive. Incidentally, the same additive, extract or antiseptic agent as in Example 1 may be also added.

Figure 7A:
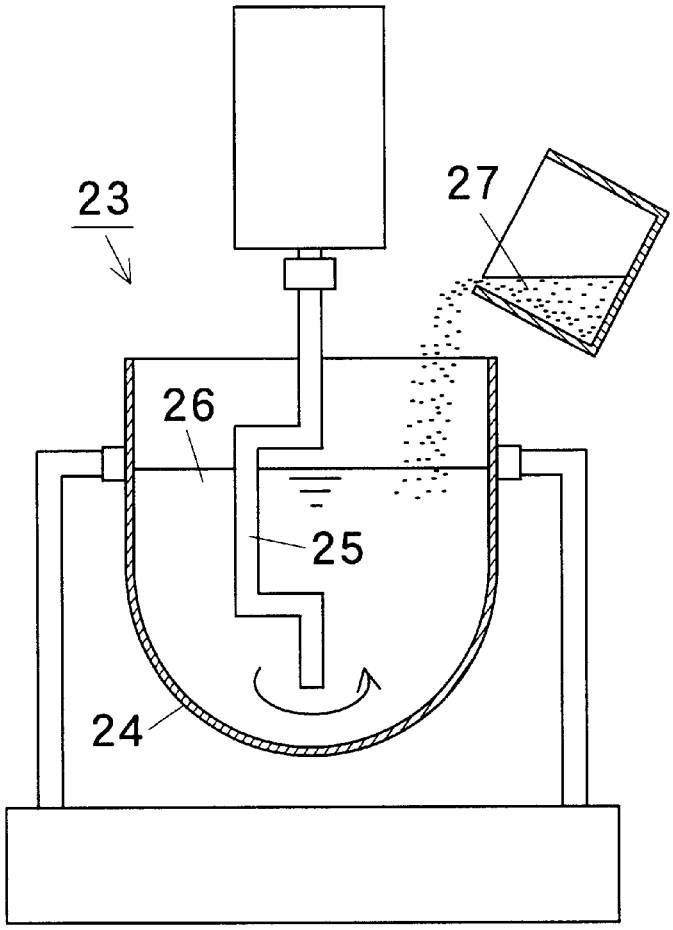
FIG. 7A–7B is a brief drawing of a rotary mixer equipped with a stirrer used for the manufacture of the solid for lubrication.
Figure 7B:
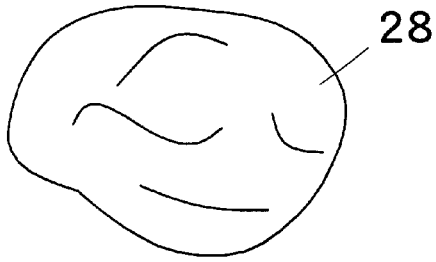

A specific kneading method will be illustrated as follows. Thus, firstly, as shown in FIG. 7A, 6 kg of water 26 were placed in a bowl container 24 of a rotary mixer 23 equipped with a stirrer and a mixture 27 of sodium polyacrylate particles and rice powder was gradually added thereto and dissolved therein with stirring by rotating the stirrer 25. In the initial stage of dissolving, the solution was an aqueous solution with a low viscosity but, with an increase in the dissolved amount of the mixture, viscosity increased and, when all of the mixture was dissolved, a gel-like solution 28 as shown in FIG. 7A was obtained.

After that, the resulting gel-like solution 28 (the kneaded product 5 of FIG. 3 may be regarded as a substitute from the gel-like solution 28) was subjected to an extrusion molding using an extruder as same as in Example 1 to mold into a rod shape and the extruded molded product was cut to give a solid for lubrication. The resulting solid for lubrication can be used by the same method as in Example 1 whereby the same effect as in Example 1 is achieved.

Test Examples 1 and 2

As mentioned already, hardness of the solid for lubrication manufactured by the methods of Examples 1 to 4 is preferably from $1\times10^4$ to $2\times10^5$ N/m$^2$ or, more preferably, from $2\times10^4$ to $1\times10^5$ N/m$^2$ by a rheometer (ambient temperature). Here, hardness of the solids for lubrication of Test Examples 1 and 2 manufactured by the same method as Example 1 was measured by a rheometer method. However, the compounding of Test Example 1 was 1.5 kg of sodium polyacrylate, 6 kg of water and a little dye and antiseptic agent while the compounding of Test Example 2 was 2 kg of sodium polyacrylate, 5 kg of water and a little dye and antiseptic agent. Further, the kneaded product obtained by the method of Example 1 was not subjected to an extrusion molding but cut in samples of a cubic shape of 30 mm square.

Figure 8A:
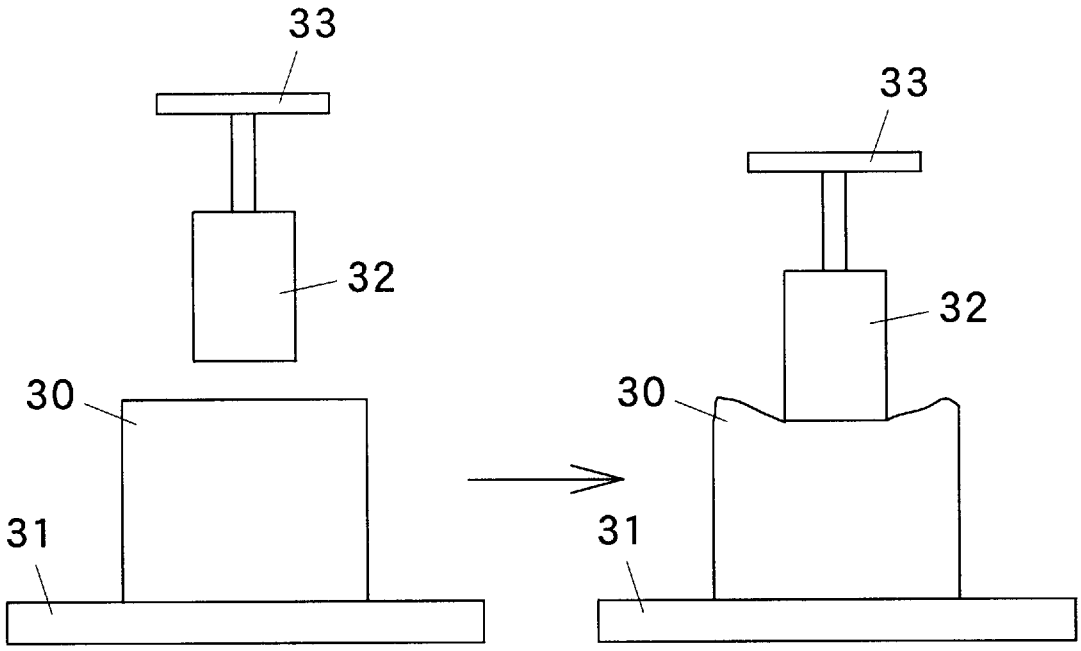
FIG. 8A is brief drawings which show a method for measuring the hardness by a rheometer method and FIG. 8B is a load vs. deformation curve by the measurement.
Figure 8B:
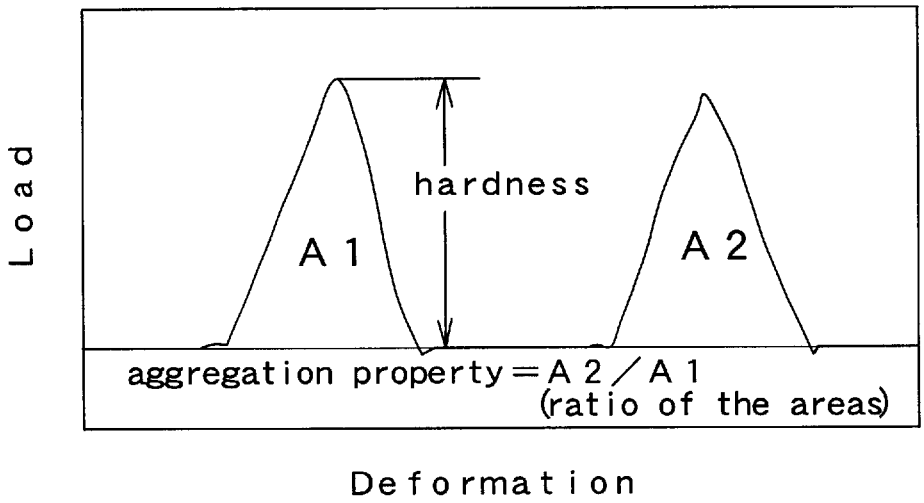

Method for the measurement by a rheometer method will be specifically illustrated as follows. As shown in FIG. 8A, a sample of 30 mm square was placed on a sample stand 31, temperature of the sample was made 25±2° C., the sample 30 was compressed under the condition that a plunger 32 in a shape of column having a diameter of 12 mm was pressed down with a compressing speed of 5 mm/second and a compressing rate of 20% and the load was detected by a load cell 33 connected to the plunger 32. In addition, as shown in FIG. 8B, an aggregation property was determined from the ratio of the areas in the load vs. deformation curves from the first and the second compressions conducted successively. Incidentally, the measurement was determined for 12 times for each sample 30 and their mean value was used as the test result. The result was that the hardness was $3.4\times10^4$ N/m$^2$ for Test Example 1 and $4.8\times10^4$ N/m$^2$ for Test Example 2 and the aggregation property was 0.9 in both cases.

Incidentally, the present invention is not limited to the above-mentioned embodiments but can be embodied with appropriate modifications so far as they do not deviate from the object of the invention.

Figure 9:
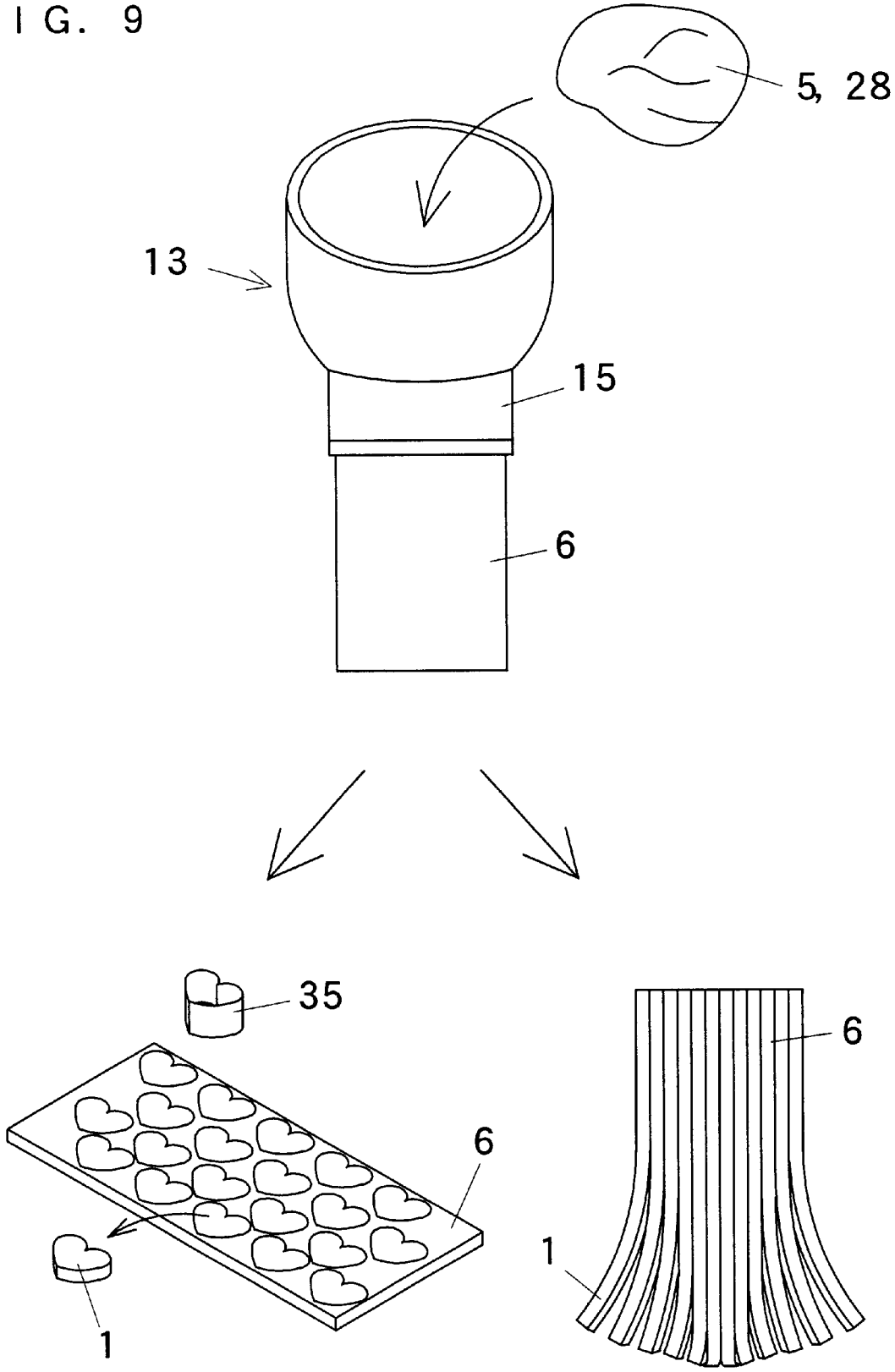
FIG. 9 is brief oblique views which show another example of molding of the solid for lubrication.

It was mentioned already that solids for lubrication 1 in various shapes can be prepared by an extrusion molding being able to be adopted in Examples 1 and 4 when size and shape of the dice 15 in the extruder 13 are changed or cutting position of the molded product 6 is changed. An example is that, as shown in FIG. 9, a molded product 6 in a shape of a plate extruded from an extruding dice 15 having a slit-shaped cross section is cut using a cutter to give a noodle-shaped solid for lubrication 1 or is punched using a punching mold to give a solid for lubrication 1 in a desired shape.

Since it is apparent that broad and different embodiments can be constituted without opposing to the spirit of the present invention, the present invention is not limited to its specific embodiments except the thing limited by the attached claims.

What is claimed is:

1. A process for the manufacture of a lubricant used for supplementing the moisture of human skin and making it slide better, comprising:

a) combining 1 part particles of a polymer being capable of dissolving in water to yield a liquid lubricant selected from the group consisting of sodium polyacrylate, polyacrylic acid, and propylene glycol with between 1 and 3 parts water to form a mixture;

b) kneading said mixture to form said mixture into a malleable solid which holds its own shape; and c) molding said mixture into a lump shape.

* * * * *